US008523030B1

(12) United States Patent
Molcho

(10) Patent No.: US 8,523,030 B1
(45) Date of Patent: Sep. 3, 2013

(54) APPARATUS AND METHOD FOR CARRYING AND RETRIEVAL OF A GRENADE

(71) Applicant: Nirtal training and supply of combat equipment Ltd., Or-Yehuda (IL)

(72) Inventor: Haim Molcho, Zur Hadassah (IL)

(73) Assignee: Nirtal Training and Supply of Combat Equipment Ltd., Or-Yehuda (IL)

( * ) Notice: Subject to any disclaimer, the term of this patent is extended or adjusted under 35 U.S.C. 154(b) by 0 days.

(21) Appl. No.: 13/648,286

(22) Filed: Oct. 10, 2012

(51) Int. Cl.
*B65D 25/10* (2006.01)

(52) U.S. Cl.
USPC ..... 224/242; 224/191; 224/660; 224/241

(58) Field of Classification Search
USPC ..... 224/242, 245, 163, 191, 660, 235, 224/241; 102/368, 482–488; D29/128
See application file for complete search history.

(56) References Cited

U.S. PATENT DOCUMENTS

| | | | | |
|---|---|---|---|---|
| 1,897,709 | A * | 2/1933 | Nigeradse | 102/486 |
| 2,067,829 | A * | 1/1937 | Denne | 169/30 |
| 2,423,993 | A * | 7/1947 | Panter et al. | 102/483 |
| 2,670,886 | A * | 3/1954 | Walton | 224/247 |
| 2,797,034 | A * | 6/1957 | Blackman | 224/603 |
| 3,448,654 | A * | 6/1969 | Crabtree et al. | 89/1.51 |
| 5,310,086 | A * | 5/1994 | Julinot | 222/1 |
| 6,561,402 | B2 * | 5/2003 | Holland et al. | 224/677 |
| 7,967,109 | B2 * | 6/2011 | Petzl et al. | 182/3 |

* cited by examiner

*Primary Examiner* — Nathan J Newhouse
*Assistant Examiner* — Scott McNurlen
(74) *Attorney, Agent, or Firm* — Soroker Agmon

(57) ABSTRACT

The subject matter discloses an apparatus, including an envelope for holding a grenade, the grenade comprises a grenade lever and a grenade safety pin; an attaching utensil for attaching the envelope to a garment of a person; a safety lever container connected to the envelope, the safety lever container is configured to secure the grenade lever, such that the grenade is oriented in a predetermined direction and a ring holder connected to the envelope, the ring holder is configured to hold the safety pin, such that the safety pin is detached from the grenade responsive to removal of the grenade from the envelope.

14 Claims, 3 Drawing Sheets

APPARATUS AND METHOD FOR CARRYING AND RETRIEVAL OF A GRENADE

FIELD OF THE INVENTION

The subject matter relates generally to a retrieval envelope for carrying grenades and rapidly deploying the grenades.

BACKGROUND OF THE INVENTION

Grenades are explosive devices used by various personnel, such as law enforcement personnel or military officers, as a projectile to attack a target at a distance from a thrower. There are various types of grenades available, such as a fragment grenade, stun grenade, smoke grenade, incendiary grenade, etc. When used, grenades create an explosion which is intended to injure, emit a blaring noise, create smoke, and the like. Grenades may be thrown through a window or door of a crime location, such as a room in a house, and the like, to temporarily distract the occupants for a time sufficient to enable the law enforcement personnel to safely enter the location and neutralize any potential threats.

The grenade is held in a throwing hand with the thumb placed over a grenade lever while a safety pin is pulled out of a safety pin hole. When the grenade is thrown, the grenade lever is released, a spring throws off the grenade lever and rotates the striker into the primer. The primer contains material similar to the head of a match. When struck, it ignites and sets fire to the fuse. The fuse burns at a controlled rate, providing a time delay, for example about four to five seconds. When the flame of the fuse reaches a detonator the grenade explodes.

In order to separate the safety pin from the grenade, the user that throws the grenade is required to hold the grenade in one hand then pull the safety pin in the other hand, thus requiring the use of both hands in the handling of the grenade. A user that operates the grenade in both hands cannot operate the single weapon at the same time. During operation, removal of the grenade from a pouch and separating the safety pin from the grenade may be inconvenient, time consuming and intricate, factors which are critical to the success of situations requiring the use of grenades.

SUMMARY

It is an object of the subject matter to discloses an apparatus, comprising an envelope for holding a grenade, said grenade comprises a grenade lever and a grenade safety pin; an attaching utensil for attaching said envelope to a garment of a person; a safety lever container connected to the envelope, said safety lever container is configured to secure the grenade lever, such that the grenade is oriented in a predetermined direction; a ring holder connected to the envelope, said ring holder is configured to hold the safety pin, such that the safety pin is detached from the grenade responsive to removal of the grenade from the envelope.

In some cases, the apparatus further comprises a top cover for covering the upper portion of the grenade, said top cover is connected to a wall of the envelope; and springs to release the top cover from the top of the grenade.

In some cases, the top cover is inserted into a slit of the wall. In some cases, the apparatus further comprises two buttons to engage the springs to release the cover from the top of the grenade.

In some cases, the bottom of the envelope comprises one or more teeth to maintain the grenade orientation. In some cases, the one or more teeth are flexible to enable removal of the grenade from the apparatus. In some cases, the ring holder is a karabiner.

In some cases, the wall of the envelope comprises a ledge to maintain the orientation of the grenade. In some cases, the ring holder is connected to the envelope by a cord, such that the safety pin is detached from the grenade responsive to moving the grenade from the envelope at a distance longer than the cord's length.

In some cases, the envelope enables human access to the grenade while the grenade is secured by the safety lever container. In some cases, the top cover is detached from the grenade.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

DETAILED DESCRIPTION

The present subject matter discloses a retrieval envelope for holding a grenade and a method of using the same, according to exemplary embodiments. A person, such as a law enforcement or military officer, inserts the grenade into the retrieval envelope, which partially envelopes the grenade while enabling rapid retrieval of the grenade. The grenade is secured in the retrieval envelope by a top cover, which is pushed down and locked into place over the top of the grenade. When the person wishes to use the grenade, he raises the top cover to enable removing the grenade. The top cover may be detached from the apparatus of the subject matter. Raising the top cover may be performed by activating a trigger, which releases a spring, which may also be a rubber band or a latch, which raises the top cover. In some cases, the trigger comprises pressing at least two triggers simultaneously to prevent unwanted release of the top cover. The grenade may further be secured by one or more teeth or flaps which hold the grenade in the retrieval envelope, but are flexible enough to enable rapid and easy removal of the grenade from the retrieval envelope. The retrieval envelope enables the person to rapidly retrieve the grenade from the retrieval envelope and throw it rapidly and accurately at a desired target. The retrieval of the grenade may be done with a single hand and may be done by a person's weak hand, while a strong hand carries a primary weapon, such as an automatic rifle.

The retrieval envelope comprises of a safety lever container for containing the grenade lever and for maintaining the orientation of the grenade in the retrieval envelope. The retrieval envelope comprises a ring holder attached to a safety pin of the grenade. The ring holder enables the person to release and use the grenade rapidly with a single hand. The ring holder holds onto the safety pin as the person moves the grenade away from the retrieval envelope, which releases the safety pin and permits throwing the grenade at a desired target. The retrieval envelope is attached to a garment, which may be a vest, a belt or any other apparel used by the person. The retrieval envelope may be attached to the garment by use of an attachment utensil, such as screws, sewing, buttons, or the like.

Figure 1:
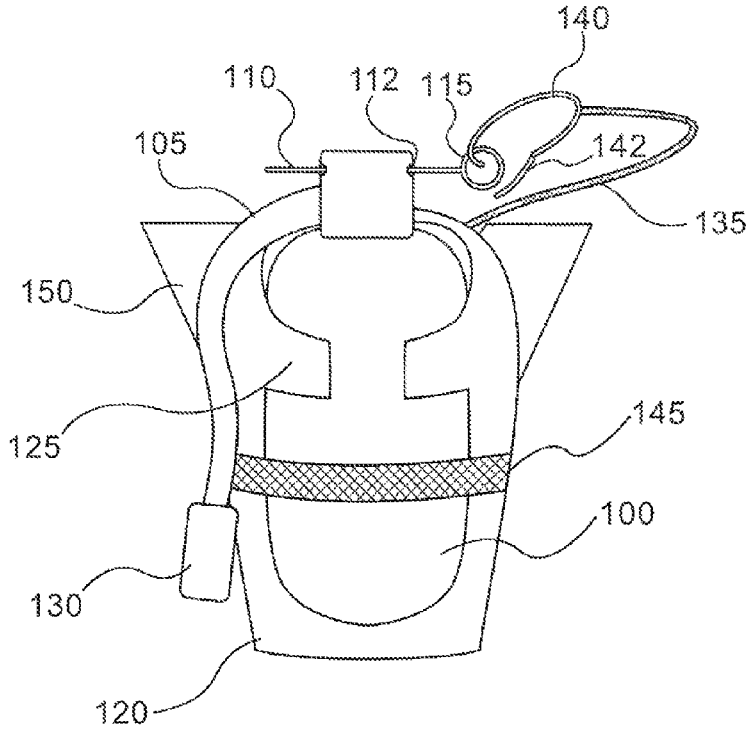
FIG. 1 shows a retrieval envelope holding a grenade, according to some exemplary embodiments of the subject matter.

FIG. 1 shows a retrieval envelope holding a grenade, according to some exemplary embodiments of the subject matter. The grenade 100 comprises a safety pin 110 and a grenade lever 105. The safety pin 110 is placed into a pin hole 112 that keeps the grenade lever 105 in place, preventing a release spring (not shown) from releasing the grenade lever 105 and detonating the grenade 100. The grenade 100 is placed into retrieval envelope 120.

The retrieval envelope 120 is designed to hold the grenade 100 so the shape of the retrieval envelope 120 is configured for quick access and use. In some exemplary embodiments, the retrieval envelope 120 may comprise flaps 125, which secure the grenade 100 in the retrieval envelope 120. The retrieval envelope 120 may comprise a safety lever container 130, which holds the grenade lever 105. Holding the grenade lever 105 at the safety lever container 130 prevents the grenade 100 from disorienting when placed in the retrieval envelope 120. In some cases, the safety lever container 130 may prevent the grenade lever 105 from releasing in situations where the safety pin 110 is prematurely removed or slips out of the safety pin hole 112.

The retrieval envelope 120 may also comprise a hook 150 to attach the retrieval envelope 120 to a garment such as a vest or a belt. The hook 150 allows convenient transportation of one or multiple retrieval envelopes 120 to and from the garment.

The retrieval envelope 120 comprises a cord 135, such as a rope or wire, which is connected to a ring holder 140. The ring holder may be a karabiner comprising a mobile limb 142. The ring holder 140 is attached to a safety pin ring 115. Once the ring holder 140 is inserted into the safety pin ring 115, the safety pin ring 115 may be removed once the person using the retrieval envelope 120 pulls the grenade 100 out and away from the retrieval envelope 120, so the safety pin 110 is released from the safety pin hole 112 by the ring holder 140.

In some exemplary embodiments of the subject matter, a rubber band 145 may be used to secure the grenade 100 in the retrieval envelope 120. The rubber band 145 is placed around the grenade 100 and the retrieval envelope 120 so the grenade 100 may be easily removed from the retrieval envelope 120 using a single hand. In some embodiments, the rubber band 145 may be attached to the retrieval envelope 120 so the rubber band 145 does not fall to the ground and get lost when the grenade 100 is removed from the retrieval envelope 120. The rubber band 145 is detached from the grenade 100 when deploying the grenade 100.

Figure 2:
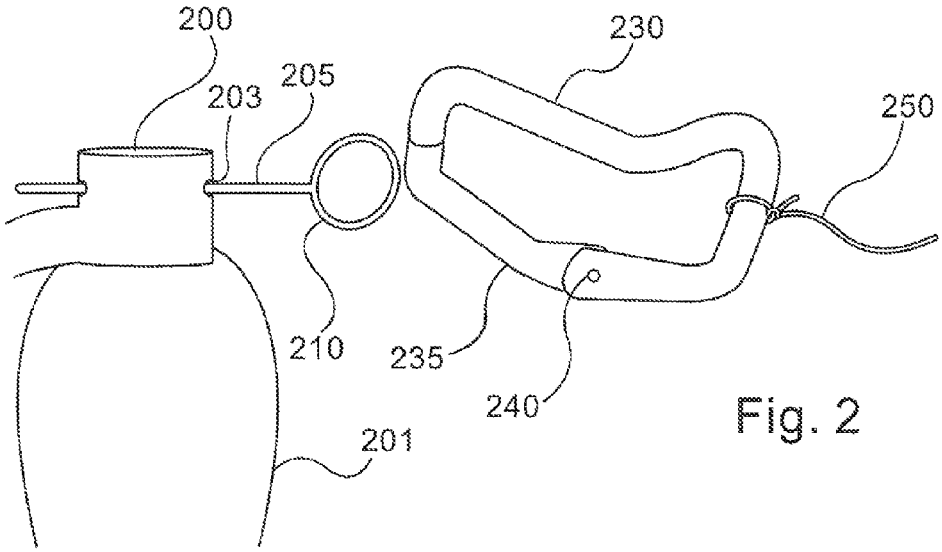
FIG. 2 shows a ring holder connection to a safety pin, according to some exemplary embodiments of the subject matter.

FIG. 2 shows a ring holder connection to a safety pin, according to exemplary embodiments of the subject matter. The safety pin 205 is inserted into a safety pin hole 203 located on a grenade lever 200 of a grenade 201. The grenade pin 205 comprises a safety pin ring 210. After the safety pin ring 210 is pulled, the safety pin 205 is removed out of the safety pin hole 203, which enables the grenade lever 200 to be released, igniting the fuse to detonate the grenade 201. A ring holder 230, such as a karabiner, is inserted into the safety pin ring 210. The ring holder 230 comprises a ring holder mechanism, such as a moveable limb 235, which can open and close to enable insertion of the ring holder 230 into the safety pin ring 210. The moveable limb 235 is attached to the body of the ring holder 230 by a bolt 240, such as a screw, which enables the moveable limb 235 to open and close. The ring holder 230 is attached to a cord 250, such as a rope or wire, which connects the ring holder 230 to the retrieval envelope 120 of FIG. 1.

Once the ring holder 230 is inserted into the safety pin ring 210, the moveable limb 235 is placed so the ring holder 230 cannot be removed from the safety pin ring 210 without opening the moveable limb 235. In some cases the ring holder 230 may have a locking bolt (not shown), such as a locking karabiner, which has the locking bolt to enable locking the moveable limb 235 into place to prevent the moveable limb 235 from opening and releasing the safety pin 205, for example, while the grenade 201 is being removed from the retrieval envelope 120 of FIG. 1.

Figure 3:
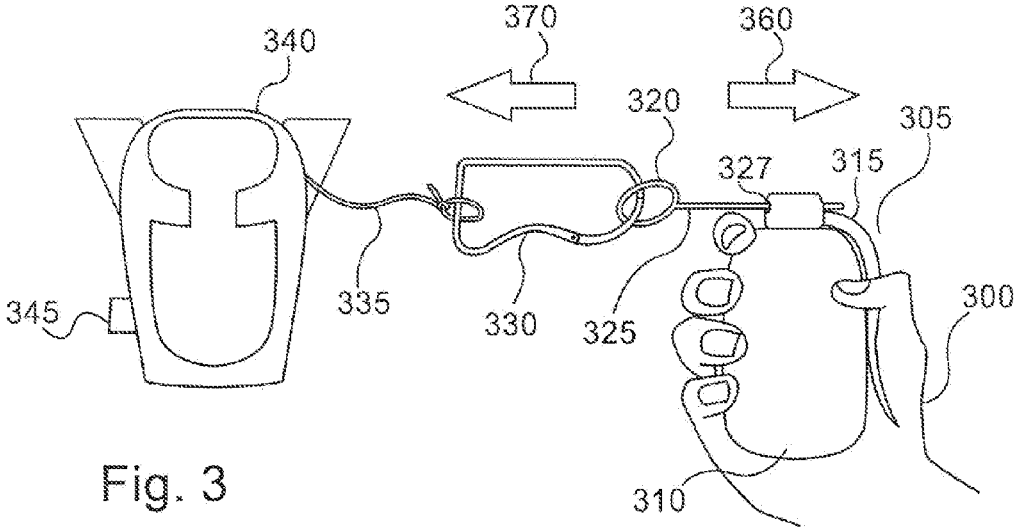
FIG. 3 shows a release of a grenade from a retrieval envelope, according to some exemplary embodiments of the subject matter.

FIG. 3 shows a method of releasing a grenade from a retrieval envelope, according to exemplary embodiments of the subject matter. A person carrying the retrieval envelope 340 uses a hand 300 to grab onto a grenade 310 located in the retrieval envelope 340. The hand 300 grabs the grenade 310 so that some fingers keep a grenade lever 315 from releasing, for example using a thumb 305 to hold the grenade lever 315 in place. The thumb 305 is used to remove the grenade 310 from the retrieval envelope 340 in a single fast motion. The grenade lever 315 is removed from a safety lever container 345 and controlled with the thumb 305 so the grenade lever 315 does not release, preventing the grenade 310 from detonating once a safety pin 325 is released. The safety pin 325 is located in a safety pin hole 327, which keeps the grenade lever 315 locked and prevents the grenade 310 from detonating until the safety pin 325 is removed from the safety pin hole 327. The safety pin 325 comprises a safety pin ring 320, attached to a ring holder 330. The ring holder 330 is inserted into the safety pin ring 320 so the ring holder 330 and the safety pin ring 320 are interlocked and cannot be detached. The ring holder 330 is attached to a cord 335, such as a rope or wire, which is connected to the retrieval envelope 340 at the opposite end of the cord 335.

To activate the grenade 310, the person carrying the retrieval envelope 340 that holds the grenade 310, grabs the grenade 310 with the person's hand 300. The person places one of his/her fingers around the grenade lever 315 to ensure that the grenade 310 does not detonate in the person's hand 300. After removing the grenade 310 from the retrieval envelope 340, the person moves the grenade 310 away from the retrieval envelope 340, for example moving the grenade 310 in a right direction 360 or moving the retrieval envelope 340 in a left direction 370. The retrieval envelope 340 enables the person to use only a single hand to remove the grenade 310 from the retrieval envelope 340 and still have a second hand free for other requirements, such as carrying an automatic rifle. The retrieval envelope 340 enables the person to rapidly remove the grenade 310 from the retrieval envelope 340 and throw it rapidly with either a person's strong or weak hand.

As the grenade 310 is moved further from the retrieval envelope 340, the cord 335 becomes tense and the ring holder 330 at the end of the cord 335 pulls the safety pin 325 out of the safety pin hole 327. The retrieval envelope 340, which sits on an garment of the person, such as a person's vest, creates tension in the cord 335, which enables the ring holder 330 to remove the safety pin 325 from the safety pin hole 327 as the grenade 310 is distanced from the retrieval envelope 340. The distance between the grenade 310 and the retrieval envelope 340 may be longer than the length of the cord 335 in order to release the safety pin 325. Once the safety pin 325 is removed from the safety pin hole 327, the grenade lever 315 is secured by the person's hand 300, for example the thumb 305. To activate the grenade 310, the person releases the grenade 310 enabling the grenade lever 315 to be released by a spring (not shown). Once the grenade lever 315 releases the fuse inside the grenade 310 ignites the primer, which detonates the grenade 310.

Figure 4:
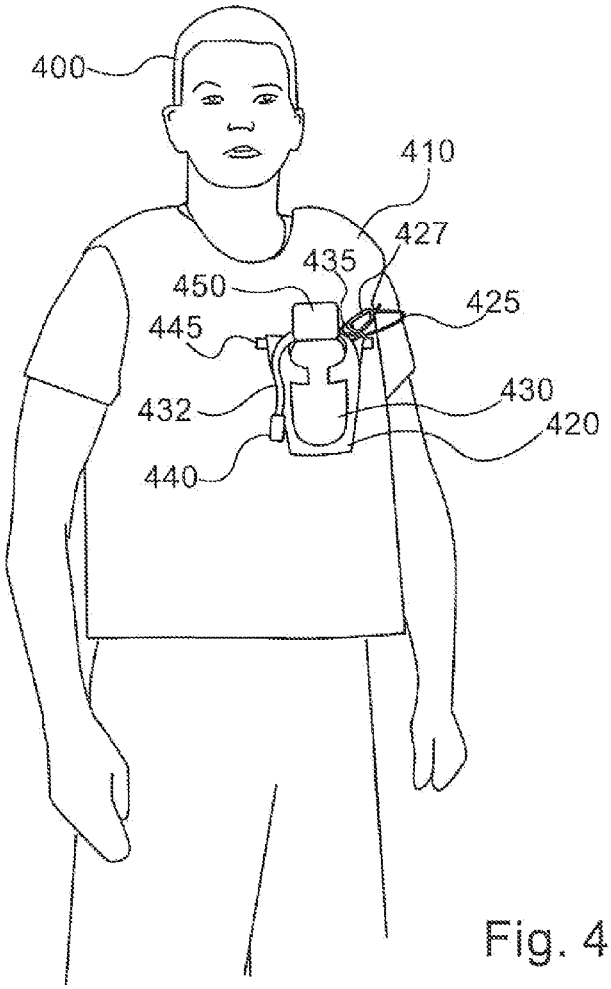
FIG. 4 shows a retrieval envelope attached to a garment on a person, according to some exemplary embodiments of the subject matter; and, FIG. 5 shows a side view of a retrieval envelope holding a grenade, according to some exemplary embodiments of the subject matter.

FIG. 4 shows a retrieval envelope attached to a garment on a person, according to exemplary embodiments of the subject matter. The person 400, such as a law enforcement officer, wears a garment 410, such as a vest or a belt (not shown), on which the retrieval envelope 420 may be attached. The retrieval envelope 420 may be attached to the garment 410 by hooks 445, screws, stitches, and the like. The retrieval envelope 420 may be attached to a mechanical track using hooks 445, which enables adjusting the location of the retrieval envelope 420 on the garment 410. The retrieval envelope 420 is attached to the garment 410 so a grenade 430 is easily accessible to the person 400. A top cover 450, which may be attached to the body of the retrieval envelope 420, is placed on top of the grenade 430, to prevent the grenade 430 from falling out of the retrieval envelope 420. A grenade lever 432 is placed in a safety lever container 440 on the retrieval envelope 420. The safety lever container 440 orients the grenade 430 so the person 400 only requires one hand to remove the grenade 430 from the retrieval envelope 420. The safety lever container 440 securely holds the grenade lever 432 so the grenade lever 432 is not detached from the grenade 430. The person 400 releases the top cover 450 from the grenade 430 using a trigger, for example by pressing two buttons that release a spring, which lifts the top cover 450 from the grenade 430. In some cases the spring may be a rubber band, a latch, or the like. The person 400 grabs the grenade 430 with the person's hand and removes the grenade lever 432 from the safety lever container 440 while removing the grenade 430 from the retrieval envelope 420. The grenade 430 is moved away from the retrieval envelope 420, for example by pulling the grenade 430, a cord 425 becomes tense and a ring holder 427, for example a karabiner, pulls on a safety pin 435 on the grenade 430. The person 400 moves the grenade 430 until the safety pin 435 is removed from the grenade 430 and remains attached to the ring holder 427. Once the safety pin 435 is removed the grenade 430 may be thrown at a desired target. When inserting the grenade 430 into the retrieval envelope 420, the user may first attach the ring holder 427 to the safety pin 435, then inserts the grenade 430 into the retrieval envelope 420 and finally covers the grenade 430 using the top cover 450.

Figure 5:
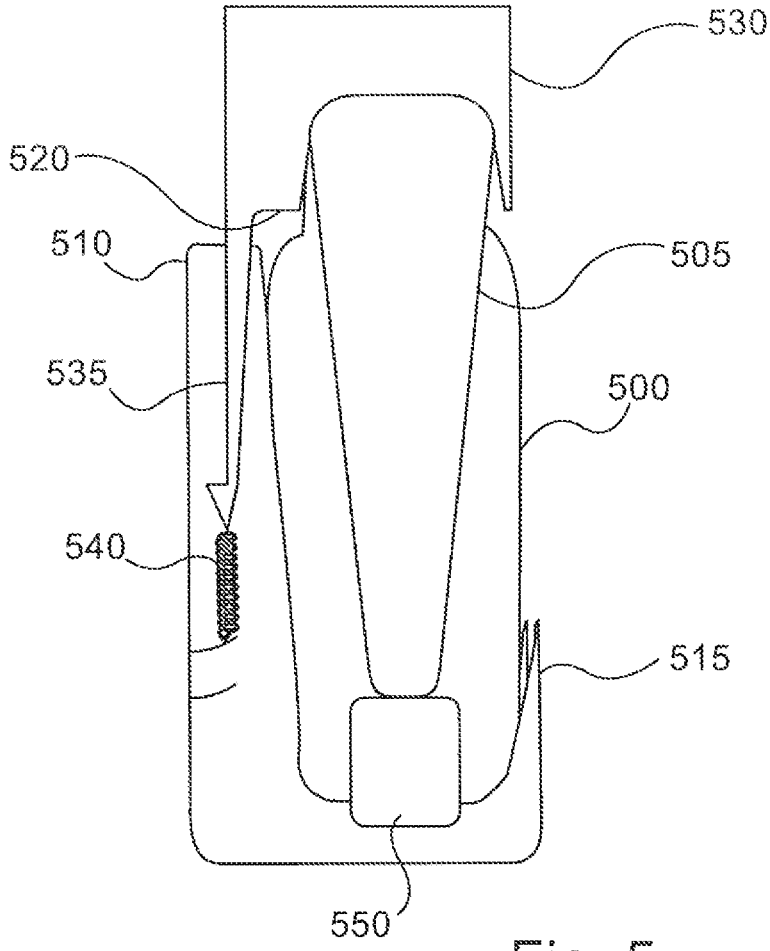

FIG. 5 shows a profile of retrieval envelope holding a grenade, according to some exemplary embodiments of the subject matter. The grenade 500 is held in the retrieval envelope 510. The grenade 500 is placed in a large cavity of the retrieval envelope 510. In some exemplary embodiments of the subject matter, the retrieval envelope 510 comprises one or more teeth 515, which are located in the opening of the large cavity and keep the grenade 500 from falling out of the retrieval envelope 510. The one or more teeth 515 are flexible, so the one or more teeth 515 bend as the grenade 500 is removed from the retrieval envelope. In some cases, the retrieval envelope 510 comprises a holding ledge 520, which prevents the grenade 500 from moving while the grenade 500 is stored in the retrieval envelope 510. The grenade 500 comprises a grenade lever 505, which is stored in a safety lever container 550. The retrieval envelope comprises a top cover 530, which is placed on top of the grenade 500 to prevent the grenade 500 from moving while being stored in the retrieval envelope 510. In some cases, the top cover 530 comprises a soft inner lining (not shown), such as a sponge or rubber, to further prevent the grenade 500 from moving while being stored in the retrieval envelope 510. The top cover 530 pushes the grenade 500 down into the retrieval envelope to prevent the grenade 500 from falling. The top cover 530 may be detached from the grenade 500. The top cover 530 comprises an elongated limb 535, which enters into a wall of the retrieval envelope 510, for example a back wall. The elongated limb 535 rests on a spring 540, which is used to raise the top cover 530 when the grenade 500 is removed from the retrieval envelope 510. In some exemplary embodiments of the subject matter, the spring 540 may be a rubber band, a latch or the like.

After the grenade 500 is placed in the retrieval envelope 510 the top cover 530 is pressed down onto the top of the grenade 500 to hold the grenade 500 in place. As the top cover 530 is brought down the extended limb 535 is locked into place inside of the retrieval envelope 510, for example, being caught on a ledge (not shown). To remove the grenade 500 from the retrieval envelope 510, a trigger of some sort, for example pressing two buttons simultaneously, is used to release the extended limb 535 and the spring 540 pushes the top cover 530 up, which enables removing the grenade 500 from the retrieval envelope 510. In some exemplary embodiments of the subject matter, the top cover 530 moves backwards in a swinging motion from the top of the grenade 500. The grenade lever 505 is removed from the safety lever container 550 and the grenade 500 is pulled out of the retrieval envelope 510 while bending the one or more teeth 515.

While the disclosure has been described with reference to exemplary embodiments, it will be understood by those skilled in the art that various changes may be made and equivalents may be substituted for elements thereof without departing from the scope of the subject matter, in addition, many modifications may be made to adapt a particular situation or material to the teachings without departing from the essential scope thereof. Therefore, it is intended that the disclosed subject matter not be limited to the particular embodiment disclosed as the best mode contemplated for carrying out this subject matter, but only by the claims that follow.

The invention claimed is:

1. An apparatus, comprising:

an envelope for holding a grenade, said grenade comprises a grenade lever and a grenade safety pin;

an attaching utensil for attaching said envelope to a garment of a person;

a safety lever container connected to the envelope, said safety lever container is configured to secure the grenade lever, such that the grenade is oriented in a predetermined direction;

a ring holder connected to the envelope or to the attaching utensil, said ring holder is configured to hold the safety pin, such that the safety pin is detached from the grenade responsive to removal of the grenade from the envelope;

a top cover connected to the upper section of the envelope for securing the grenade to the envelope from a top side of the grenade by covering the upper portion of the grenade;

thereby the apparatus enables release and operation of the grenade from the envelope using a single hand of the user;

wherein the envelope includes sides extending downward from the attaching utensil and a bottom for supporting the bottom of the grenade, wherein the safety lever container is located outside the envelope.

2. The apparatus of claim 1, wherein the top cover is pushed down and locked into place over the top of the grenade.

3. The apparatus of claim 1, wherein the bottom of the envelope comprises one or more teeth to maintain the grenade orientation.

4. The teeth of claim 3, wherein the one or more teeth are flexible to enable removal of the grenade from the apparatus.

5. The apparatus of claim 1, wherein the ring holder is a karabiner, wherein a safety pin ring connected to the safety pin is inserted into the karabiner; thereby enabling removing the ring holder without removing the safety pin.

6. The apparatus of claim 1, wherein a wall of the envelope comprises a ledge to maintain the orientation of the grenade.

7. The apparatus of claim 1, wherein the ring holder is connected to the envelope by a cord, such that the safety pin is detached from the grenade responsive to moving the grenade from the envelope at a distance longer than the cords length.

8. The apparatus of claim 1, wherein the envelope enables human access to the grenade while the grenade is secured by the safety lever container.

9. The apparatus of claim 1, wherein the ring holder comprises a moveable limb, which can open and close to enable insertion of the ring holder into the safety pin ring, wherein the moveable limb is attached to the ring holder by a bolt, which enables the moveable limb to open and close.

10. The apparatus of claim 1, wherein the top cover is pushed down and locked into place over the top of the grenade;

wherein the bottom of the envelope comprises one or more teeth to maintain the grenade orientation, said one or more teeth are flexible to enable removal of the grenade from the apparatus;

wherein the ring holder is a karabiner, wherein a safety pin ring connected to the safety pin is inserted into the karabiner; thereby enabling removing the ring holder without removing the safety pin;

wherein a wall of the envelope comprises a ledge to maintain the orientation of the grenade;

wherein the ring holder is connected to the envelope by a cord, such that the safety pin is detached from the grenade responsive to moving the grenade from the envelope at a distance longer than the cord's length;

wherein the envelope enables human access to the grenade while the grenade is secured by the safety lever container;

wherein the ring holder comprises a moveable limb, which can open and close to enable insertion of the ring holder into the safety pin ring, wherein the moveable limb is attached to the ring holder by a bolt, which enables the moveable limb to open and close;

wherein the ring holder is inserted into the safety pin ring, the moveable limb is placed so the ring holder cannot be removed from the safety pin ring without opening the moveable limb.

11. An apparatus, comprising:

an envelope for holding a grenade, said grenade comprises a grenade lever and a grenade safety pin;

an attaching utensil for attaching said envelope to a garment of a person;

a safety lever container connected to the envelope, said safety lever container is configured to secure the grenade lever, such that the grenade is oriented in a predetermined direction;

a karabiner connected to the envelope, wherein a safety pin ring connected to the safety pin is inserted, into the karabiner; such that the safety pin is detached from the grenade responsive to removal of the grenade from the envelope;

wherein the karabiner pulls the safety pin from the grenade responsive to removal of the grenade from the envelope;

wherein the envelope includes sides extending downward from the attaching utensil and a bottom for supporting the bottom of the grenade, wherein the safety lever container is located outside the envelope.

12. The apparatus of claim 11, wherein the karabiner is connected to the envelope or the attaching utensil by a cord, such that the safety pin is detached from the grenade responsive to moving the grenade from the envelope at a distance longer than the cord's length.

13. The apparatus of claim 11, further comprises a top cover connected to the upper section of the envelope for securing the grenade to the envelope from a top side of the grenade by covering the upper portion of the grenade; and thereby the apparatus enables release and operation of the grenade from the envelope using a single hand of the user.

14. The apparatus of claim 9, wherein the ring holder is inserted into the safety pin ring, the moveable limb is placed so the ring holder cannot be removed from the safety pin ring without opening the moveable limb.

* * * * *